United States Patent [19]

Jarman

[11] 4,100,975

[45] Jul. 18, 1978

[54] POWER BOOSTER

[75] Inventor: Gladys T. Jarman, Brunswick, Ga.

[73] Assignees: Davis R. Jarman; Virgil Hinson, both of Brunswick, Ga.

[21] Appl. No.: 680,795

[22] Filed: Apr. 27, 1976

[51] Int. Cl.[2] ..... H01R 5/00

[52] U.S. Cl. ..... 173/91; 173/119

[58] Field of Search ..... 173/91, 92, 119, 120, 173/121

[56] References Cited

U.S. PATENT DOCUMENTS

| | | | |
|---|---|---|---|
| 2,783,670 | 3/1957 | Graves et al. | 173/120 |
| 3,094,901 | 6/1963 | Wandel et al. | 173/121 |
| 3,331,603 | 7/1967 | Webb | 173/119 |
| 3,605,915 | 9/1971 | Gately et al. | 173/119 |

*Primary Examiner*—Robert A. Hafer

*Attorney, Agent, or Firm*—Clarence A. O'Brien; Harvey B. Jacobson

[57] ABSTRACT

A power booster assembly for use to increase the power used in pulling or driving tool mechanism such as used in straightening an automobile frame and the like. A cylindrical body having closed ends and attachment means at each of the ends with a power piston mounted for reciprocation therein together with a spring biased hammerhead which is latchable on to one end of the power piston for fluid actuation of said piston to draw the hammerhead against the spring bias. Cam release structure within the body causes the hammer latch mechanism to be released and permits the hammerhead to trip and bang against one closed end of the cylinder with tremendous force. Repeated action of catching and releasing the hammerhead takes place according to the amount of fluid being permitted into the power cylinder. Valve mechanism is arranged to automatically cause proper reciprocation of the power piston according to the amount of fluid and the pressure thereof being fed to the assembly.

2 Claims, 8 Drawing Figures

POWER BOOSTER

BACKGROUND OF THE INVENTION

1. Field of the Invention

This invention relates generally to assemblies for boosting the power of pulling or pushing type apparatus. It may be employed with automobile straightener devices as well as used with devices like jack hammers and the like.

2. Description of the Prior Art

A recognized problem with known type of pushing and pulling structures is that the amount of leverage or power application is often not enought to accomplish the job. Some manner of boosting the power, generally of an intermittant type is commonly used to help effect the overall job.

Another known problem with previous type booster assemblies is that they are unduly complicated and require a lot of maintenance. Also, they are not easily controlled as to rate and speed of operation.

Another common problem is that the usual valving mechanism associated with such boosters is elaborate and susceptable to failure and sticking.

SUMMARY OF THE INVENTION

An object of the present invention is to provide a power booster apparatus for increasing the power of a pushing or pulling structure with which it is associated.

Another object of the present invention is to provide a power booster apparatus having a reciprocating power piston which is controllable by fluid means as to rate of reciprocation together with latching means for pulling a hammer against a spring bias and allowing same to be tripped for exerting a powerful blow to the apparatus.

A further object of this invention is to provide a power booster apparatus having adjustable fluid means for controlling the rate of repetition of the power boost cycle.

A still further object of this invention is to provide a fluid operated valve and piston assembly which is semi-automatic in operation and controllable by a single fluid valve control.

A still further object of this invention is to provide a power booster cylinder having a fluid operated power piston therein together with a plurality of latching fingers for releasable engagement with a hammerhead mechanism which is spring biased within the overall power booster cylinder.

A still further additional object of this invention is to provide a power booster assembly which is relatively maintenance free, easy to adjust, and easy to operate by unskilled personnel.

The power booster apparatus of this invention has many advantages over conventional type boosters. It comprises an enclosed cylindrical main body having a spring biased hammerhead engagable with one end of said body and a fluid operated piston mounted within the other portion of the body with an extending connecting rod portion having a support member with latching fingers engagable with the hammerhead structure so that once the latch fingers catch the hammerhead structure and the power piston is actuated to the far end of the cylinder by fluid means the hammerhead will be drawn against the spring biasing. Upon reaching the end of the cylinder, appropriate cam mechanism is provided to force the catch fingers to a release position for permitting the hammerhead under the force of the spring biasing to be driven with great force against the other end of the cylinder body. Appropriate valve mechanism is provided together with permanent ports for effecting the fluid input to the power piston so as to cause the reciprocation of same. A single fluid valve is all that is required in order to properly control the rate of reciprocation of the power piston. In a modified embodiment of this invention the position of engagement of the latching fingers with the cam structure is also adjustable.

Another important feature of this invention is that the power booster is relatively maintenance free, and may be easily operated by an unskilled mechanic. A single fluid valve is all that is necessary in order to control the overall booster. The booster of this invention would greatly increase the power associated pulling or pushing equipment and in turn increase the overall effectiveness thereof.

Another important feature of this invention is that the overall power booster apparatus is compact and streamlined, and may be easily carried and stored. It requires very little room for storage and/or operation and is extremely effective in its power boost action.

Another feature is that the overall apparatus is extremely strong and resistant to droppage and mishandling. All moving parts are completely enclosed and protected from abuse from either misuse or accident. Also, all moving elements are completely sealed and protected from dirt and contaminants which will be injurous to most conventional type boosters.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
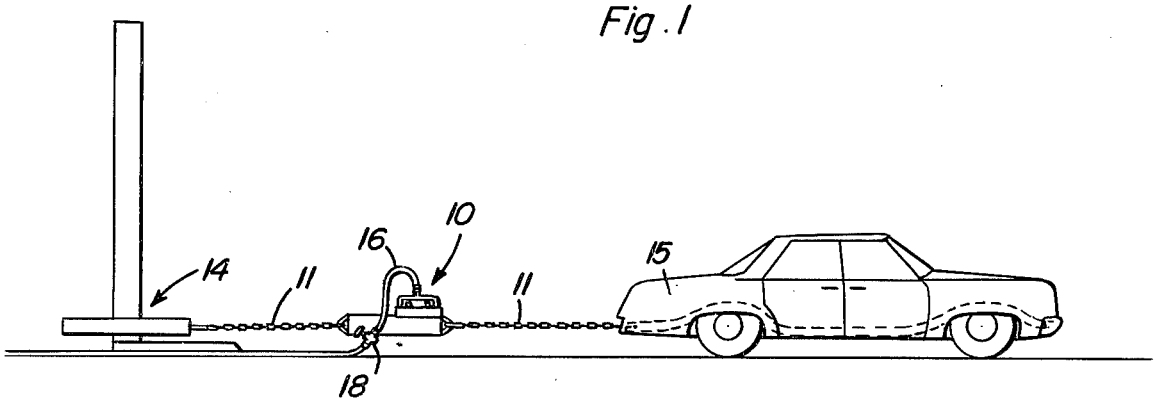
FIG. 1 is a side view of the device as in one type of use.

Referring to FIG. 1 of the drawings, reference numeral 10 indicates in general the power booster apparatus of this invention as in one type of useful application. As shown, the power booster is connected by means of chains or cables 11 at each end thereof to an anchored jack stand 14 which is mounted in a conventional manner and an automobile frame 15 for the straightening thereof. A fluid line input 16 is connected to the power booster and controlled by a single valve 18. The fluid being supplied may be either pneumatic or hydraulic as desired. The overall apparatus being designed for use with either. However, since most garage and automobile repair shops have a ready source of high compressed air available pneumatic normally would be used in such areas.

Figure 3:
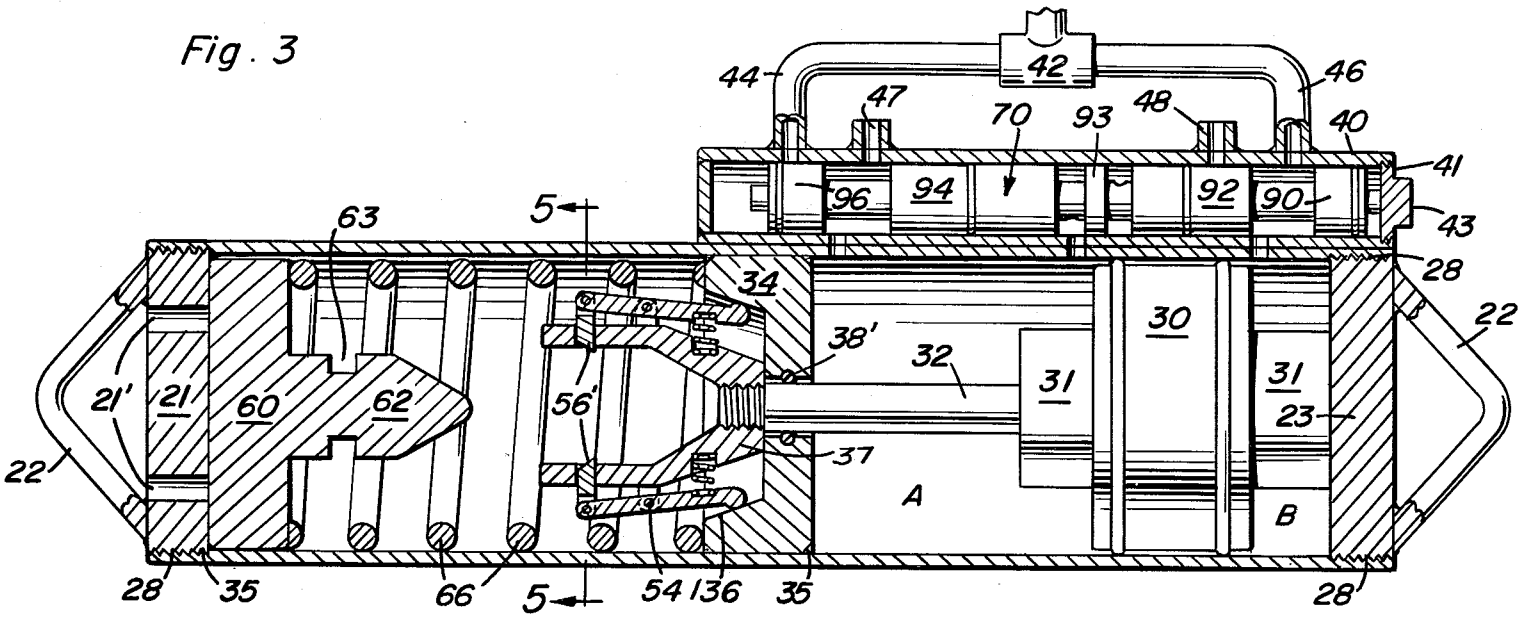
FIG. 3 is a side elevational view, partly in cross-section generally taken along line 3—3 of FIG. 2 with the power piston and the operating valve both to the far right.
Figure 4:
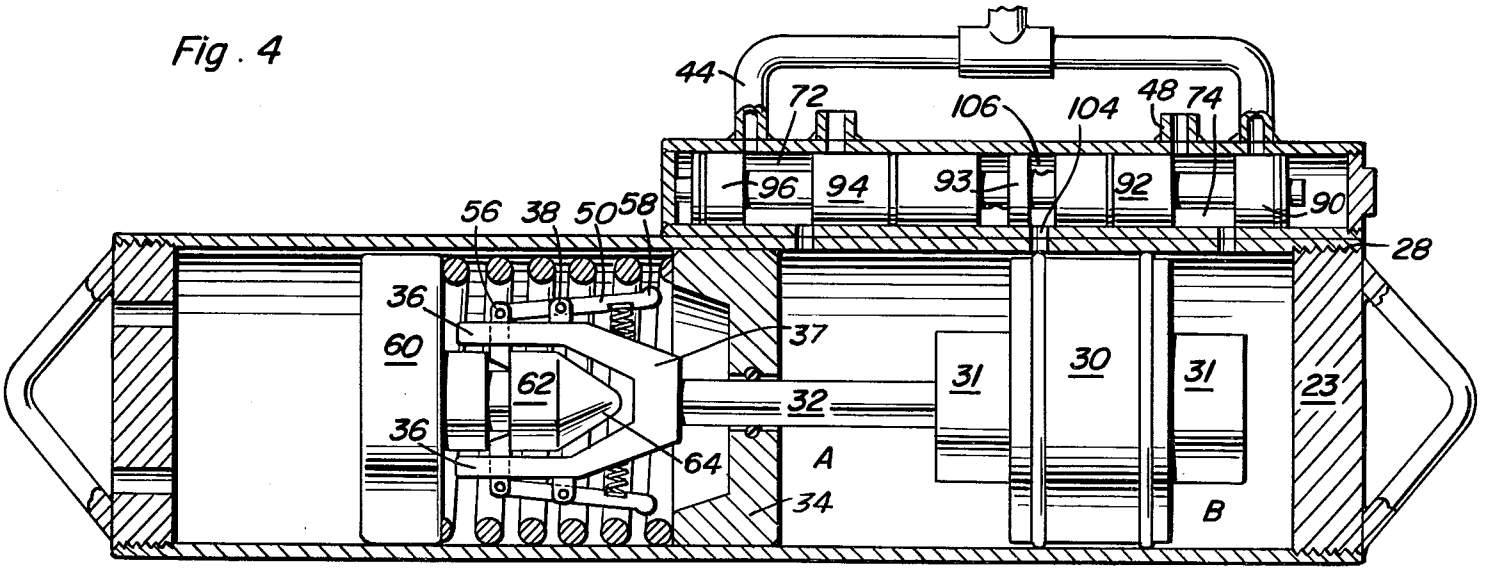
FIG. 4 is a side elevational view, partly in cross-section similar to FIG. 3, but with the power piston approximately mid-way in the power cylinder and the actuating valve to its extreme left position.
Figure 6:
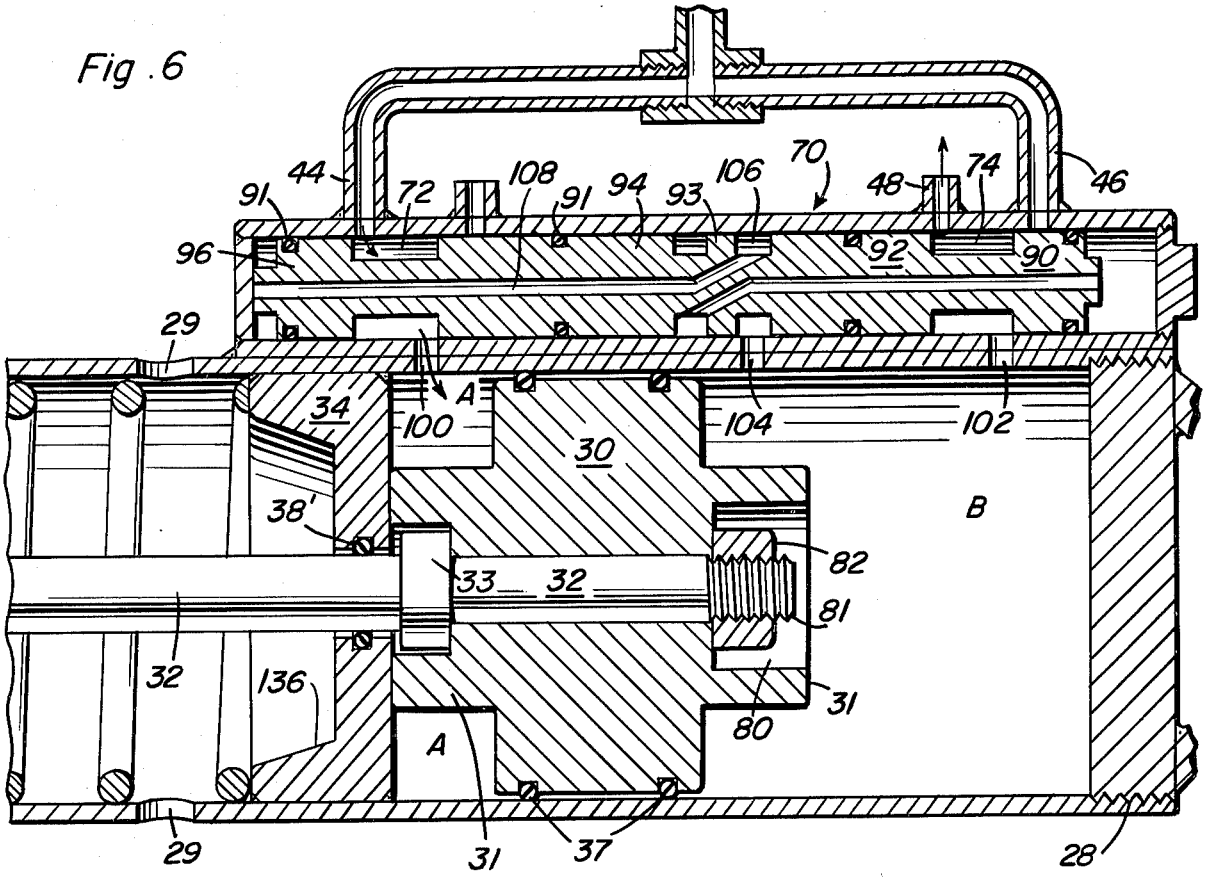
FIG. 6 is an enlarged side elevational view, in cross-section, showing the power cylinder portion of the power booster with both the fluid valve and the power piston to the left.
Figure 7:
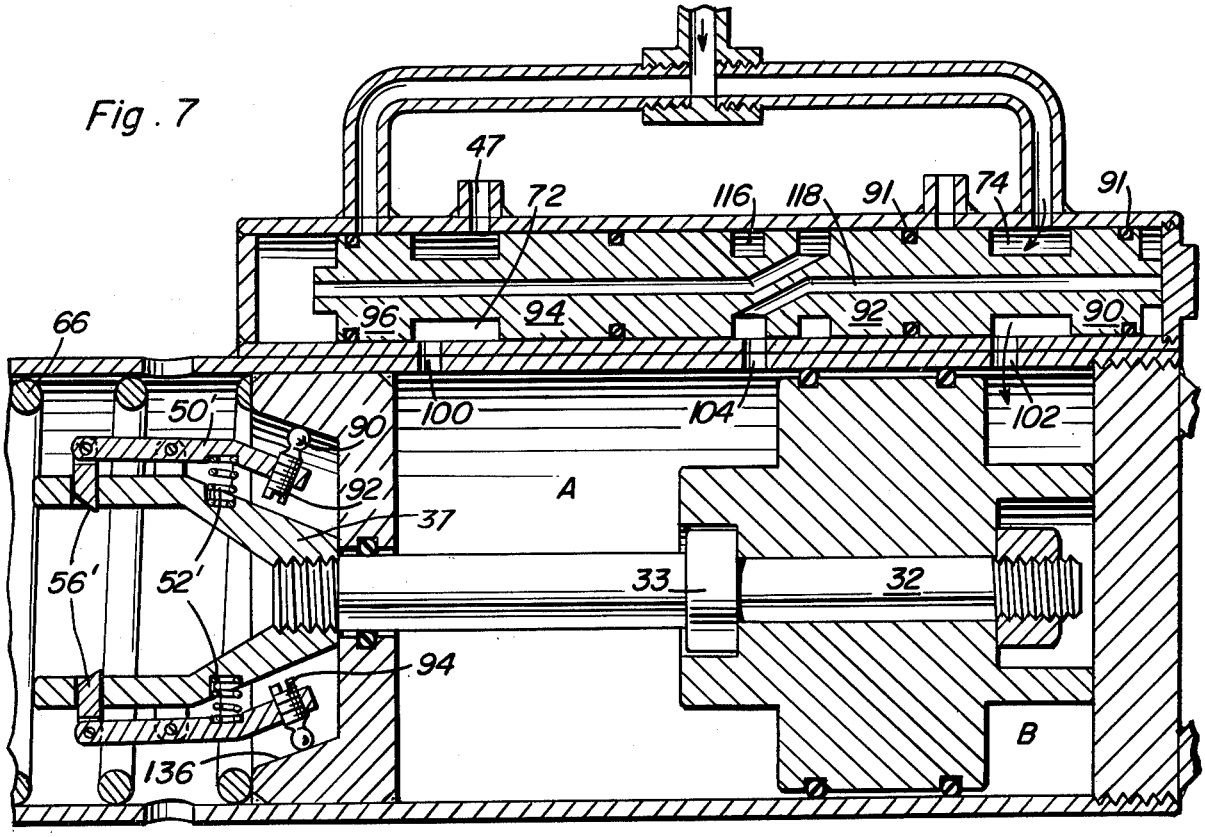
FIG. 7 is a view similar to FIG. 6, but with the fluid valve and the power piston to the extreme rightmost positions. Also, the adjustable cam engaging portions for the latching fingers are shown partly in cross-section.

Looking at FIGS. 2, 3 and 4, the basic device will be described. A main cylinder member 20 is provided having inserts 21 and 23 provided at each end thereof by removable means such as screw threads 28 or the like. The closure 23 at the right end of the structure as best seen in FIG. 3, forms a fluid type closure for the right end of the main cylinder member 20. The left side enclosure insert 21 has appropriate apertures 21' provided therein for permitting escape of air from this end. Both of the ends have coupling members 22 provided thereon for use of the device as a pulling power booster. However, one or the other of these ends could be fitted with a hammer, chisel, arbor structure or other similar means for converting the power booster to pushing or hammering type operations. Approximately midway between the inner portion of the main cylinder member is fastened a separator member 34. This member 34 may be retained in place by a pressfit, suitable welding 35, or the like. The side of member 34 facing the hammerhead portion of the device is provided with a cam recess surface 136. A power piston 30 is mounted within the right side portion of the main cylinder member for power reciprocation between the airtight enclosures 23 and 34. O-rings 37 seal the piston against leakage in the cylinder, conventional type piston rings may also be used, if desired. The power piston 30 has suitable protrusions 31 extending from each side thereof and a connecting rod member 32 connected therethrough and extending through an aperture in the partition 34. The rod 32, as best seen in FIGS. 6 and 7 of the drawings, has an enlarged shoulder 33 spaced approximately a pistonhead distance away from the right end of the rod for engagement within the recessed aperture of the left side projection 31 on the powerhead 30. The right side end of the connecting rod 32 is suitably threaded at 81 for receiving a locknut 82 thereon to positively fasten the rod 32 on the powerhead 30. The right side projection 31 has a suitable aperture 80 provided therein which is large enough size to provide space between the inside wall of projection 31 and the locknut 82 for the purpose of removal and replacement of the pistonhead when necessary. The other end of connecting rod 32 passes through a suitable aperture 38 within the partition member 34 having a suitable O-ring 38' for fluid sealing purposes in a conventional manner.

Mounted within the left side portion of the main cylinder member is a hammerhead 60 having a projection of cylindrical shape 62 with a conical nose cone provided thereon 64, and also provided with a circumferential recess 63 at approximately the mid-seciton of the cylindrical portion. A bias spring 66 is suitably provided between the inner portion of the hammerhead 60 and the outer flange portion of central member 34 as best seen in FIGS. 3 and 4.

Mounted upon the left side of the connecting rod 32, by screw threads or other suitable connection, is a main support member 37 for the latching fingers to be described below. This support 37 has at least two protruding finger projections 36 provided thereon for pivotally supporting latch arms 50 thereon. Projecting flanges or standards 38 are provided on the projecting fingers 36, and the latch arms 50 are pivotally supported thereon by the pins 54. Latching catch fingers 56 are pivotally connected to the latch arms 50 at one end thereof and bias springs 52 are provided for spring biasing the opposite ends of the latch arms 50 in an outwardly direction. This inturn will bias the latching catch fingers 56 toward an inward position relative to the center line of the connecting rod 32. The end of the latch arms 50 closest to the bias springs 52 have rounded cam surfaces 58 provided thereon for engagement with the complementary cam surface 136 on the partition member 34. Thus, as seen in FIG. 3, when the piston 30 is to the far right of the power cylinder, the cam portions 58 of the latch arms 50 will be in engagement with cam surface 136 of member 34 to positively withdraw the latch catch fingers 56 to their outermost position with respect to the support member 37. In this position, the latch fingers 56 will completely release the hammerhead member 60.

When the power piston 30 moves toward the left as viewed in the drawings, as soon as the latch fingers 50 pass out of range of the cam surface 136, the springs 52 will cause the catch fingers 56 to be moved inwardly to their latch engaging position with respect to the hammerhead. As the power piston continues its movement toward the left, the cam surfaces 56' on the ends of the catch fingers will engage the conical cam projection on the nose cone 62 of the hammerhead to be again forced outwardly against the bias of springs 52 until the connecting rod 32 and piston 30 move far enough to the left that the fingers 56 can drop into the recess or groove 63 provided in the hammerhead projection. At this point, the latching connection is made being appropriately shown in FIG. 4. Then as the power piston moves back toward the right, the hammerhead 60 will be drawn along therewith because of the latching connection of fingers 56 within the recess 63 and against the bias spring 66 to compress same and store up energy within the power booster.

Upon the piston and rod reaching the far right side position, once again, the cam surface 136 will engage with the cam portions 58 on the end of the latch arms 50 and effect a release of the catch fingers 56 from the recess 63 within the hammerhead projection. Immediately, upon the release of the hammerhead 60, because of the strong force of heavy spring 66 the hammerhead will slam against the fixed end 21 with tremendous force which will, in turn, cause the entire cylinder member 20 to move slightly to the left. Thus, it can be visualized that if the power booster is connected as shown in FIG. 1 with the left side portion 21, 22 connected to a take-up jack structure 14 and the right hand side connected to an automobile frame to be straightened, when the power booster head slams hard to the left and creates a tremendous power shock, there will be a tremendous multiplied force applied to the automobile frame which then will be taken up by the jack 14, and which will be repeated in rapid multiple fashion.

In order for the powerhead piston 30 to properly reciprocate within the power cylinder, it is necessary to provide proper valve action for control of same. The valve structure is enclosed within a housing 40 appropriately mounted by welding or other suitable fastening means to the outer surface of the main cylinder member 20. The valve housing contains therewithin another smaller cylindrical chamber having one end closed with a fixed member and at least one end provided with a removable plug or closure 41, appropriately threaded or otherwise retained within the valve cylinder. As shown in FIG. 3, the plug 41 is provided with a wrench engagable projection 43 to permit easy removal and replacement of the plug. The purpose of the plug is to permit the valve member 70 contained within the cylinder to be replaced or to have the O-rings for fluid sealing purposes replaced as they become worn and begin to leak. A fluid input tee 42 is suitably connected to an input 44 and 46 mounted on the outer portion of the valve housing 40. Exhaust ports 47 and 48 are also provided. The tee 42 is suitably connected to the fluid supply line 16 and having a valve 18 mounted in said line.

The primary valve member 70 has a plurality of land or piston portions 90, 92, 94, 93 and 96 provided thereon. Appropriate apertures or recesses are provided between these land portions for operation of the valve structure to be described below.

Figure 2:
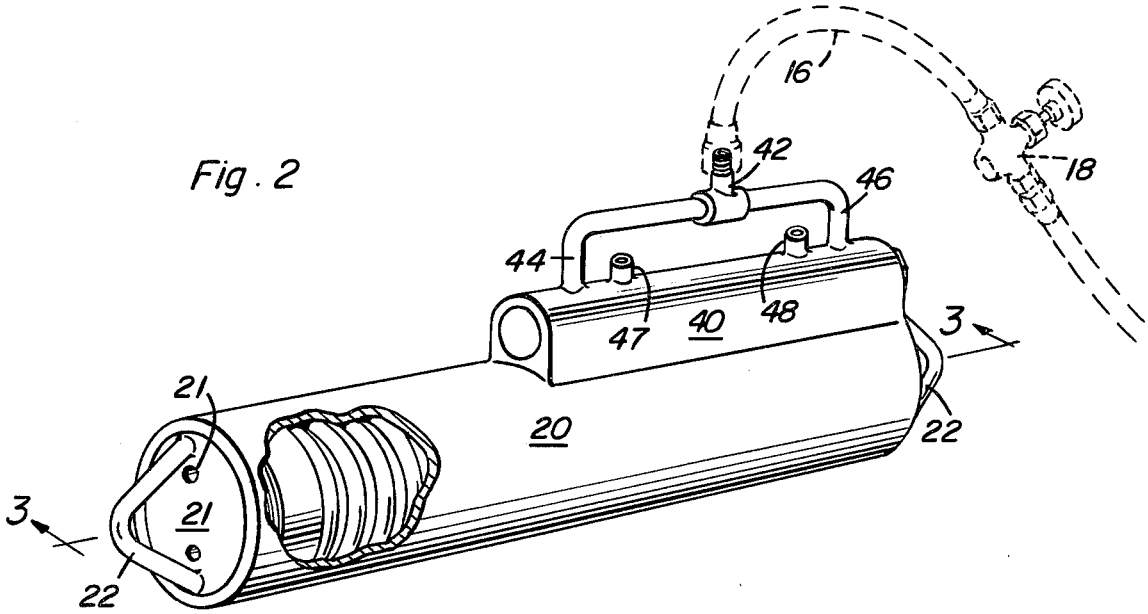
FIG. 2 is a perspective view of the power booster apparatus of this invention.
Figure 5:
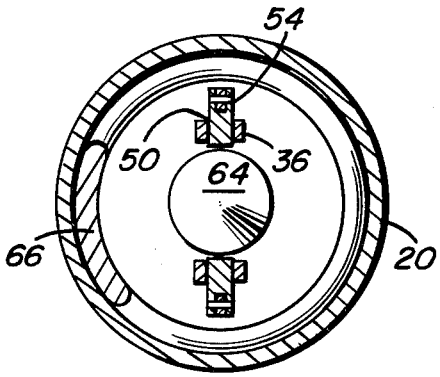
FIG. 5 is an end view, partly in cross-section, taken generally along line 5—5 of FIG. 3.

Looking at FIG. 2, the fluid input, either air or oil, is applied by means of the flexible coupling member 16 and regulated by the valve member 18. A tee coupling 42 receives this fluid input and divides same equally into the valve member 40 inputs 44 and 46. Appropriate exhaust ports 47 and 48 are also shown in FIG. 2.

Now looking at FIGS. 3, 4, 6 and 7, the operation of the valve structure together with the power piston will be set forth in detail. As seen in FIG. 6 the primary valve element 70 as well as the power piston 30 are both to the far leftmost positions within their respective cylinders. As can be seen, fluid input to the tee 42 will pass through the entrance input 44 into the chamber 72 provided by the valve member between lands 96 and 94. The input 46 will be blocked from fluid flow because of being covered by the land 90 on the valve member. Thus, the fluid will flow through the valve chamber 72 and into aperture 100 into the chamber A formed between the power pistonhead 30 and the central cylinder separating member 34. This chamber is formed because of the projection 31 which prevents the pistonhead 30 from completely engaging with the cylinder separating member 34.

The fluid under pressure will now push against the power piston 30 and said piston will begin to move towards the right. Residual air contained within the chamber B to the right of the piston and within the cylinder will exhaust out aperture 102 through the passageway 74 between the lands 90 and 92 on the valve member and out exhaust port 48. Aperture 104 provided midway between apertures 100 and 102 will be covered by the piston 30 until such time as the piston 30 is almost to the rightmost position within the cylinder. This stage in the operation may best be seen by reference to FIG. 4. Note that at this portion of the operation the primary valve member is still in the leftmost position within its respective cylinder. However, as the piston 30, as seen in FIG. 4, moves slightly more to the right, that is the position shortly before that shown in FIGS. 3 and 7, it can be visualized that the aperture 104 will become uncovered by the piston and the fluid pressure within chamber A will pass through the aperture 104. From 104 the pressure fluid flows into the recess chamber 106 provided between the lands 92 and 93, best seen in FIG. 6. An appropriate longitudinally and substantially centerly provided passageway 108 connects the recess chamber 106 of the primary valve member to the far left end of same. Thus, the pressure fluid flowing into the chamber 106 will pass through this passageway and emerge out the leftmost end of said valve member. This obviously exerts pressure against the left portion of the valve member which forces said valve member to the far right. Thus, upon substantial completion of the power piston stroke the valve member is automatically moved from the far leftmost position, as seen in FIGS. 4 and 6, over to the farmost right position, as seen in FIGS. 3 and 7. In the farmost right position the input at 44 will now be blocked by the land portion 96 of the valve member, while the input 46 will now be open to the chamber or recess 74 provided between the lands 90 and 92. As seen in FIG. 7, the pressure fluid input will flow through the chamber 74 into aperture 102 and into the chamber B at the head or rightmost end of the power piston. This pressure will exert force against the top or righthand of the piston cylinder and said piston will begin to move toward the left.

As the power piston moves toward the left, air of a residual nature, or in the case of hydraulic fluid, any residual air and fluid, will exhaust from chamber A out aperture 100 through the valve recess chamber 72 and out exhaust 47. Again, the power piston will continue to the left until such time as the central aperture 104 is again uncovered for receiving the pressure fluid in order to shift the valve member once again in the opposite direction. Thus, it can be seen that the primary valve member and power piston working together with the apertures as shown and described will automatically reverse each other and the rate and speed of such reversal will be dependent upon the input fluid pressure as controlled by the input valve 18. With the input valve 18 wide open or to the greatest opening thereof, maximum fluid pressure will be permitted into the device and the maximum rate will be achieved thereby. As the valve is cut down or partially closed, obviously the rate of reciprocation will be decreased until such time as the valve is completely closed, at which time the device will cease to operate.

Figure 8:
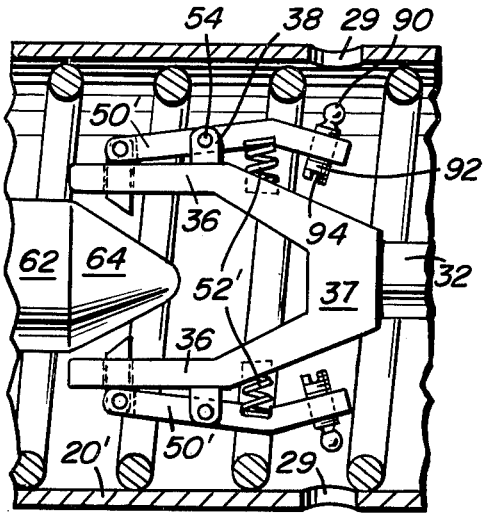
FIG. 8 is a side elevational view of the midportion of the power booster apparatus, partly in cross-section, and showing the adjustable latching fingers and access holes therefore.

FIGS. 6 and 7, together with FIG. 8 show a modified embodiment of the cam mechanism for the latch arms 50. These arms, labeled 50', are pivotally mounted in the same manner as the latch arms already described, and have appropriate catch fingers 56' pivotally mounted at one end thereof and bias springs 52' at the other end thereof for the same method of operation already described. However, instead of having cam portions 58 formed at the other end of said latch arms, cam balls 90 adjustably mounted on screw threaded body portions 92 are provided. The body portion 92 has appropriate adjustment slots 94 provided therein. Also, apertures 29 are provided within the cylinder housing for access to the adjustments of these cam members. With this modified embodiment, the camming action of the latch arms 50 may be adjusted to some degree in order to modify the point at which the hammerhead 60 is released. This adjustment also allows for variation in case of wear of the inner cam surface 36 of the separator 34 and/or wear of the ends of the latch arms 50.

From the above description of structure and method of operation, one can readily visualize how high energy repeated shocks will be provided by this device as connected and shown in FIG. 1, and also as envisioned for use as jack hammers, power drivers, power chisels and the like.

The device being entirely self-contained and having only one control valve will be simple and easy to use by unskilled mechanics or laborers, while also preventing contamination and damage to the delicate inner parts because of the complete overall enclosure of the structure.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A power booster assembly comprising; a hollow cylinder member with spaced end walls, a piston and rod mounted for reciprocating movement within the cylinder member, a hammerhead slidably contained entirely within the cylinder biased to a one of the end walls of the cylinder member provided with an air passage, latch means mounted on the rod and spaced from the piston for alternately gripping and releasing the hammerhead, valve means associated with the cylinder member for feeding input fluid into the cylinder member to effect reciprocation of the piston within the cylinder member, and the latch means being arranged for releasing the hammerhead at one end of the longitudinal movement thereof with the rod and cause the hammerhead to release from the rod and strike the one of the end walls to create a shock thereon, the latch means including a support member on the connecting rod and opposite the piston and at least one latching finger on the support member for catching and releasing a projecting member extending from the hammerhead and facing inwardly of the cylinder member, the latch means including means having a cam surface arranged substantially midway of the cylinder member for engagement with the latching finger to effect the release thereof from the latch connection with the hammerhead projection, adjustable means provided between the cam surface and the latching finger for varying the point of engagement therebetween, the at least one latching finger being a plurality of like latching fingers and associated adjusting means, and the adjusting means including an adjustable set screw provided with a cam ball on one end thereof and appropriately mounted by means of the screw portion in associated screw threaded apertures in the ends of each finger.

2. The structure set forth in claim 1, wherein the valve means includes a valve cylinder member arranged on the side of a cylinder member and provided with input and output ports connected with the cylinder member, and a reciprocating valve member provided within the valve cylinder member.

* * * * *